US009261804B2

(12) United States Patent
Yamazaki et al.

(10) Patent No.: US 9,261,804 B2
(45) Date of Patent: Feb. 16, 2016

(54) TONER

(71) Applicant: CANON KABUSHIKI KAISHA, Tokyo (JP)

(72) Inventors: Katsuhisa Yamazaki, Numazu (JP); Daisuke Yoshiba, Suntou-gun (JP); Koji Nishikawa, Susono (JP); Shotaro Nomura, Suntou-gun (JP); Hiroki Akiyama, Toride (JP); Masami Fujimoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 14/444,986

(22) Filed: Jul. 28, 2014

(65) Prior Publication Data

US 2015/0037722 A1 Feb. 5, 2015

(30) Foreign Application Priority Data

Aug. 1, 2013 (JP) ..... 2013-160756

(51) Int. Cl.
*G03G 9/08* (2006.01)
*G03G 9/087* (2006.01)

(52) U.S. Cl.
CPC ..... *G03G 9/08* (2013.01); *G03G 9/0821* (2013.01); *G03G 9/08755* (2013.01); *G03G 9/08786* (2013.01); *G03G 9/08788* (2013.01); *G03G 9/08791* (2013.01); *G03G 9/08795* (2013.01); *G03G 9/08797* (2013.01)

(58) Field of Classification Search
CPC ..... G03G 9/08755; G03G 9/09797; G03G 9/087
USPC ..... 430/109.1, 109.4, 111.4
See application file for complete search history.

(56) References Cited

U.S. PATENT DOCUMENTS

| | | | |
|---|---|---|---|
| 5,578,409 | A | 11/1996 | Kotaki et al. |
| 8,158,319 | B2 | 4/2012 | Arima et al. |
| 2001/0026899 | A1 | 10/2001 | Uchida et al. |
| 2011/0076609 | A1 | 3/2011 | Hwang et al. |
| 2013/0108954 | A1 | 5/2013 | Tsujimoto et al. |

FOREIGN PATENT DOCUMENTS

| | | | |
|---|---|---|---|
| JP | 3015244 | B2 | 3/2000 |
| JP | 2003-98939 | A | 4/2003 |
| JP | 2003-302875 | A | 10/2003 |
| JP | 2010-107673 | A | 5/2010 |
| JP | 2011-81355 | A | 4/2011 |
| JP | 2011-521294 | A | 7/2011 |
| WO | 2012/090741 | A1 | 7/2012 |

OTHER PUBLICATIONS

U.S. Appl. No. 14/446,290, filed Jul. 29, 2014. Applicant: Daisuke Yoshiba, et al.
European Search Report dated Dec. 18, 2014 in European Application No. 14179242.4.

*Primary Examiner* — Mark A Chapman
(74) *Attorney, Agent, or Firm* — Fitzpatrick, Cella, Harper and Scinto

(57) ABSTRACT

The present invention provides a toner that exhibits an excellent low-temperature fixability and an excellent ejected paper adhesiveness during high-speed printing, without affecting the long-term storage stability, in which the toner has a toner particle that contains a resin component, wherein the toner has, in a DSC curve measured with a differential scanning calorimeter, a glass transition temperature of at least 50° C. and not more than 65° C. and a cold crystallization peak during cooling of at least 40° C. and not more than 70° C., and has an endothermic peak in a DSC curve measured with a differential scanning calorimeter for the resin component of at least 70° C. and not more than 95° C.

6 Claims, No Drawings

TONER

BACKGROUND OF THE INVENTION

1. Field of the Invention

The present invention relates to a toner for use in electrophotography method, in image-forming methods that visualize an electrostatic image, and in toner jets.

2. Description of the Related Art

Higher speeds and greater reliability are being relentlessly pursued for image-forming apparatuses that use electrophotographic methods. In addition, the demands for better energy conservation on the part of the apparatus are also high, and in order to respond to these there is strong demand for an excellent low-temperature fixability on the part of the toner. The low-temperature fixability is generally related to the viscosity of the toner and requires an ability to rapidly melt when heated during fixing (the so-called sharp melt property). However, a toner that is satisfactory with regard to this low-temperature fixability is fragile with respect to external stresses such as stirring in the developing device and temperature increases in the unit, and problems then readily arise such as adhesion to machine components and a decline in durability because the external additives are embedded. In addition, in an image-forming apparatus whose speed has been increased, the printed recording paper is ejected on a short paper interval and accumulates in large amounts. As a result, the accumulated recording paper may stick to itself and become inseparable, or a magnetic toner that has undergone a single fixing may peel off and transfer to another sheet of paper. These are known as problems related to adhesion of ejected paper. This type of development readily appears in toners that have been endowed with low-temperature fixability in order to respond to high-speed printing, and having the low-temperature fixability co-exist with support for higher speeds is a very highly problematic technical hurdle.

Japanese Patent No. 3,015,244 and Japanese Patent Application Laid-open No. 2011-521294 propose the use of a polyester resin that has been at least partially modified with a compound that has a terminal hydroxyl group or carboxyl group and a long-chain alkyl group having a certain number of carbons. It is taught that this makes it possible to obtain a toner with an excellent charging stability, fixability, storage stability, and developing characteristics. However, in both cases, while a certain effect is seen on the low-temperature fixability, if too much focus is placed on improving the sharp melt property, recrystallization after heating during fixing is slow and the problems related to adhesion of ejected paper, supra, have a tendency to be significant.

Japanese Patent Application Laid-open No. 2011-81355 and Japanese Patent Application Laid-open No. 2010-107673 propose the use of an alkenyl group-containing amorphous polyester resin and a crystalline polyester that has an ester group concentration in a certain range. It is taught that this makes it possible to obtain an electrophotographic toner that, while providing an excellent low-temperature fixability, has an excellent charging stability at high temperatures and high humidities and an excellent storage stability. In these cases again, while a certain effect is seen on the low-temperature fixability, if too much focus is placed on improving the sharp melt property, recrystallization after heating during fixing is slow and the problems related to adhesion of ejected paper, supra, have a tendency to be significant. It is known that the recrystallization temperature of a crystalline material is generally lower than its melting point. Since, in order to improve upon the problems related to adhesion of ejected paper while delivering a satisfactory low-temperature fixability, a toner is required that melts at a low temperature and that recrystallizes at as high a temperature as possible, the technical hurdle here is very high.

In addition, in order to use the crystalline materials cited above, control of the state of existence within the polyester resin is critical. Materials that have very high plasticity, such as are used in the documents cited above, generally have a slow crystallization rate, and due to this they may recrystallize during storage, depending on the toner storage environment (temperature, humidity), and it may not be possible to realize the desired properties.

The proposal is made in Japanese Patent Application Laid-open No. 2003-98939 that the adhesion of ejected paper be stopped by cooling recording paper that has assumed a high temperature after fixing. However, improvements to the toner are required since the introduction of a cooling system into the machine is itself problematic for small desktop printers.

The proposal is made in Japanese Patent Application Laid-open No. 2003-302875 that adhesion of ejected paper be stopped by monitoring the temperature of the paper after ejection and modifying sequence in the unit (for example, opening up the paper interval) in correspondence to this temperature.

An improvement in adhesion of ejected paper is seen in this case also, but when one considers the productivity (number of prints made per unit time), this is a proposal that reduces the productivity and thus there is still room for improvement.

Thus, no proposal has yet been made wherein a better low-temperature fixability in an image-forming apparatus co-exists in good balance with improvements to the problems related to adhesion of ejected paper. This is because boosting the low-temperature fixability in association with increasing the speed and inhibiting adhesion of ejected paper post-fixing are antithetical effects, and having these co-exist in good balance is thus shown to be highly problematic.

SUMMARY OF THE INVENTION

The present invention provides a toner that solves the problems cited above.

The present invention provides a toner that exhibits an excellent low-temperature fixability and that can suppress contamination of the fixing member and adhesion of ejected paper during high-speed printing, without affecting the long-term storage stability.

The present invention relates to a toner comprising a toner particle that contains a resin component, wherein:

in a first DSC curve of the toner, measured with a differential scanning calorimeter, the first DSC curve being obtained by raising measurement temperature, the toner has a glass transition temperature of at least 50.0° C. and not more than 65.0° C., the toner has a peak temperature at a cold crystallization peak in a second DSC curve, of at least 40.0° C. and not more than 70.0° C., the second DSC curve being obtained by lowering measurement temperature, and in a third DSC curve of the resin component, measured with a differential scanning calorimeter, the third DSC curve being obtained by raising measurement temperature, the resin component has a peak temperature at an endothermic peak of at least 70.0° C. and not more than 95.0° C.

The present invention can provide a toner that exhibits an excellent low-temperature fixability and that can suppress contamination of the fixing member and adhesion of ejected paper during high-speed printing, without affecting the long-term storage stability.

Further features of the present invention will become apparent from the following description of exemplary embodiments.

DESCRIPTION OF THE EMBODIMENTS

In order to obtain a toner having an excellent low-temperature fixability, the toner must melt rapidly in the small amount of time during passage through the nip of the fixing unit. In order, on the other hand, to obtain a toner for which the ability to suppress adhesion of ejected paper (also referred to hereafter as the ejected paper adhesiveness) is excellent, solidification during the rapid cooling after passage through the fixing unit is required. Control of the melting characteristics of the resin component that is the major component of the toner is generally known as a tactic for bringing about rapid melting by the toner. However, control of the melting characteristics of the resin component itself has a very large effect on the high-temperature offset resistance and the low-temperature offset properties and the blocking resistance.

Various investigations have thus been carried out into methods that control the melting characteristics of the resin component through a plasticizing effect using a fixing assistant (an additive such as a low melting point wax or a crystalline polyester). Since control of the plasticizing effect due to the addition of such a separate material is to a large extent fundamentally conditioned on the compatibility with the resin component, an increase in the low-temperature fixability often assumes a trade-off relationship with the offset resistance at high temperatures and the blocking resistance.

In addition, this control of the melting characteristics has in the past been investigated with a heavy emphasis on the melting characteristics during a temperature rise (the so-called sharp melt property).

As a result of investigations by the inventors, it was shown that the recrystallization temperature and/or recrystallization rate may be very different even for fixing assistants that have similar melting characteristics, and that the recrystallization temperature and recrystallization rate of these toners are closely related to the ejected paper adhesiveness.

As a result of investigations in order to solve the trade-off behavior so the low-temperature fixability may co-exist with the ejected paper adhesiveness, the present inventors arrived at the idea that this contradiction could be solved by a toner that melts very rapidly upon receiving heat during fixing and that rapidly recrystallizes when the paper is ejected from the printer unit.

That is, the toner of the present invention is a toner comprising a toner particle that contains a resin component, wherein in a first DSC curve of the toner, measured with a differential scanning calorimeter, the first DSC curve being obtained by raising measurement temperature, the toner has a glass transition temperature of at least 50.0° C. and not more than 65.0° C., and the toner has a peak temperature at a cold crystallization peak in a second DSC curve, of at least 40.0° C. and not more than 70.0° C., the second DSC curve being obtained by lowering measurement temperature, and in a third DSC curve of the resin component, measured with a differential scanning calorimeter, the third DSC curve being obtained by raising measurement temperature, the resin component has a peak temperature at an endothermic peak of at least 70.0° C. and not more than 95.0° C.

As the temperature rises, a toner generally undergoes a phase transition at the glass transition temperature from a glassy state to a supercooled liquid state and the melting characteristics are somewhat modified. As the temperature rises after this, motion of the polymer molecules in the toner becomes active, and due to this the melting characteristics of the toner decline as the temperature rises. The same phenomenon also occurs during the toner cooling process. Thus, a phase transition occurs from the supercooled liquid state to the glassy state as cooling proceeds. The change in this melting characteristic is closely related to the fixing performance and the ejected paper adhesiveness.

Moreover, the surface temperature of the paper that has passed through the fixing unit is from at least 70° C. to not more than 100° C. in a common printer. In addition, while the toner on the ejected paper does gradually decline in temperature, it still holds at from at least 40° C. to not more than 70° C. during the accumulation period, and control of the melting characteristics in this temperature range is thus very important.

When the glass transition temperature of the toner in the DSC curve measured with a differential scanning calorimeter is less than 50.0° C. in the present invention, this indicates that the resin component in the toner will begin to move at a temperature near to room temperature, in which case the long-term storage stability of the toner will decline. Furthermore, when the glass transition temperature is less than 50.0° C., this indicates that the melted toner has a low temperature for phase transition to the glassy state during the cooling period after passage through the fixing unit. That is, this indicates that a long time is required for the toner to undergo phase transition from the melted state to the glassy state. In such a case, the ejected paper adhesiveness undergoes a decline in particular during high-speed printing.

When, on the other hand, the glass transition temperature is higher than 65.0° C., this indicates that the resin component in the toner is slow to start to move, and in such a case the low-temperature fixability is reduced.

In order to bring about additional improvements in the characteristics cited above, the glass transition temperature of the toner is preferably from at least 50.0° C. to not more than 60.0° C.

The glass transition temperature of the toner can be adjusted into the indicated range by controlling the glass transition temperature of its resin component.

When in the present invention the peak temperature at the cold crystallization peak in the DSC curve of the toner, measured with a differential scanning calorimeter, the DSC curve being obtained by lowering measurement temperature (also referred to below simply as "the peak temperature at the cold crystallization peak during cooling"), is less than 40.0° C., this indicates that the recrystallization temperature of the crystalline compound in the toner is low or the recrystallization rate of the crystalline compound in the toner is slow. In such a case, the ejected paper adhesiveness is reduced during high-speed printing in particular. When, on the other hand, the peak temperature at the cold crystallization peak during cooling is higher than 70.0° C., the recrystallization rate will be rapid and the recrystallization temperature will be high, and as a consequence contamination of the fixing roller will readily appear.

In order to bring about additional improvements in the characteristics indicated above, the peak temperature of the cold crystallization peak during cooling of the toner is preferably from at least 50.0° C. to not more than 70.0° C.

When a plurality of cold crystallization peaks are present during cooling for the toner of the present invention, the peak temperatures of all the cold crystallization peaks are to satisfy the indicated temperature range.

The peak temperature of the endothermic peak of the resin component in the DSC curve measured with a differential scanning calorimeter is from at least 70.0° C. to not more than 95.0° C. for the toner of the present invention.

When the peak temperature of the endothermic peak of the resin component in the DSC curve measured with a differential scanning calorimeter is less than 70.0° C., this indicates that the resin component in the toner is quickly set in motion, and the long-term storage stability of the toner is reduced in such a case.

When, on the other hand, the peak temperature of the endothermic peak is higher than 95.0° C., this indicates that the resin component in the toner is slowly set in motion, and the low-temperature fixability is reduced in this case.

In order to bring about additional improvements in the indicated characteristics, the peak temperature of the endothermic peak of the resin component is preferably from at least 70.0° C. to not more than 90.0° C.

When a plurality of these endothermic peaks are present for the resin component, the peak temperatures of all the endothermic peaks are to satisfy the indicated temperature range.

As has been indicated in the preceding, a toner for which the low-temperature fixability and the ejected paper adhesiveness during high-speed printing co-exist in good balance can be obtained, without affecting the long-term storage stability, by controlling the melting characteristics during toner heating and cooling so as to be matched to the surface temperature of the paper from its passage through the fixing unit to stacking of the discharged paper.

Viewed from the perspective of facilitating control of the melting state and recrystallization state of the toner during passage through the fixing unit, the resin component of the toner of the present invention preferably contains a crystalline polyester resin and a hybrid resin in which a polyester segment and a vinylic polymer segment are chemically bonded.

This hybrid resin in which a polyester segment and a vinylic polymer segment are chemically bonded (also referred to below simply as the "hybrid resin") has a peak temperature for the cold crystallization peak during cooling in the DSC curve measured with a differential scanning calorimeter preferably of from at least 45.0° C. to not more than 60.0° C. and more preferably from at least 50.0° C. to not more than 60.0° C.

The peak temperature for the cold crystallization peak during cooling of the toner in the DSC curve measured with a differential scanning calorimeter is easily controlled into the desired range by having the peak temperature for the cold crystallization peak during cooling of the hybrid resin be in the indicated range.

When the peak temperature for the cold crystallization peak during cooling of the hybrid resin in the DSC curve measured with a differential scanning calorimeter is less than 45.0° C., the crystalline compound present in the toner has a low recrystallization temperature and the recrystallization rate also tends to be slow. In such a case the ejected paper adhesiveness during high-speed printing in particular assumes a declining trend. When, on the other hand, the peak temperature for the cold crystallization peak during cooling is higher than 60.0° C., the recrystallization rate is rapid and the recrystallization temperature tends to increase, and as a consequence there is a tendency for fixing roller contamination to become substantial.

The hybrid resin has a softening point, measured using a constant-load extrusion-type capillary rheometer, preferably of at least 120.0° C. and not more than 145.0° C. and more preferably at least 120.0° C. and not more than 140.0° C. When this range is obeyed, the low-temperature fixability readily co-exists in good balance with the high-temperature offset resistance and the development stability during durability testing also tends to be excellent.

The softening point of the hybrid resin can be adjusted into the indicated range by controlling the composition of the monomer making up the hybrid resin and by controlling the THF-insoluble matter as provided by extraction of the hybrid resin by heating under reflux in tetrahydrofuran (THF).

A segment that melts in a prescribed temperature range is preferably introduced in the present invention in the polyester segment that constitutes the hybrid resin. A segment that can improve the fixing performance and a segment that maintains the stiffness and viscosity of the resin can each be provided within one resin by the presence of the vinylic polymer segment in the hybrid resin and by the introduction of a segment that melts in a prescribed temperature range in the polyester segment in the hybrid resin. The use in the toner of such a hybrid resin makes it possible for the low-temperature fixability and the storability·durability, which are generally considered to be conflicting properties, to co-exist in good balance. This is also preferred from the standpoint of controlling the compatibility when co-used with a plastic compound, for example, a crystalline polyester. For example, when a crystalline polyester is used in combination with a polyester resin into which a segment that melts in a prescribed temperature range has been introduced, rather than using the specified hybrid resin, the crystalline polyester undergoes compatibilization and may not take on a crystalline structure.

The hybrid resin used in the present invention preferably has an endothermic quantity of from at least 0.20 J/g to not more than 7.00 J/g for the endothermic peak obtained in the DSC curve measured with a differential scanning calorimeter. It is even easier to bring about co-existence between the low-temperature fixability and storability when the endothermic quantity for the endothermic peak is in the indicated range.

The hybrid resin used in the present invention preferably contains from at least 3.0 mass % to not more than 40.0 mass %, with reference to the hybrid resin, of THF-insoluble matter as provided by extraction by heating under reflux in tetrahydrofuran (THF). A toner with an excellent fixing performance and offset property is obtained by having the THF-insoluble matter in the hybrid resin be in the indicated range.

The mass ratio between the polyester segment and the vinylic polymer segment (polyester segment:vinylic polymer segment) in the hybrid resin used in the present invention is preferably 55:45 to 95:5. A toner with an excellent low-temperature fixability and excellent durability·storability is obtained when the mass ratio between the polyester segment and the vinylic polymer segment is in the indicated range.

The tetrahydrofuran (THF)-soluble matter of the hybrid resin preferably has a peak molecular weight (Mpt) of from at least 3,000 to not more than 15,000 and a weight-average molecular weight (Mwt) of from at least 10,000 to not more than 100,000, as measured by gel permeation chromatography (GPC).

The monomer used in the polyester segment of the hybrid resin used by the present invention is described in the following.

A segment that melts in a prescribed temperature range is preferably present in the polyester segment in the hybrid resin used in the present invention. In order to bring about the presence of such a segment, a portion with a partially aligned orientation is preferably present in the resin. As a means for realizing the presence of such a portion, a configuration in which a long-chain fatty acid or long-chain alcohol (these two may be collectively referred to hereafter as "long-chain monomer") is bonded at a terminal of the polyester segment is preferred from the standpoint of obtaining the effects of the present invention. The incorporation of the long-chain monomer at a terminal of the polyester segment enables facile control of the site at which the long-chain monomer is present and enables the incorporation of a segment to be melted uniformly in the polyester segment. When the polyester segment has a branched chain, this "terminal" also includes the terminal of this branched chain.

Specifically, a configuration is preferred in which at least one aliphatic compound selected from the group consisting of aliphatic monocarboxylic acids having a peak value for the number of carbon atoms of from at least 25 to not more than 102 and aliphatic monoalcohols having a peak value for the number of carbon atoms of from at least 25 to not more than 102, is condensed to a terminal of the polyester segment. A configuration is more preferred in which the polyester segment has a branch chain and condensation to a terminal of this branch chain is effected.

The peak value for the number of carbon atoms in the aliphatic monocarboxylic acid and aliphatic monoalcohol is preferably from at least 25 to not more than 80 and more preferably from at least 30 to not more than 80. By having the peak value for the number of carbon atoms be from at least 25 to not more than 102, orientation occurs easily within the resin and the presence of a segment that melts in a prescribed temperature range can then be brought about.

Here, the "peak value for the number of carbon atoms" is the number of carbon atoms derived from the main peak molecular weight for the long-chain monomer.

The aliphatic monocarboxylic acid and aliphatic monoalcohol may each be primary, secondary, or tertiary.

Among the preceding, a secondary aliphatic monoalcohol is particularly preferred because this facilitates the assumption of a eutectic structure with the crystalline polyester resin and keeps the acid value of the resin component down (this makes such as improvement of charging characteristics and moisture adsorbability possible).

The aliphatic monocarboxylic acid can be exemplified by saturated fatty acids such as cerotic acid (number of carbon atoms=26), heptacosanoic acid (number of carbon atoms=27), montanoic acid (number of carbon atoms=28), melissic acid (number of carbon atoms=30), lacceric acid (number of carbon atoms=32), tetracontanoic acid (number of carbon atoms=40), pentacontanoic acid (number of carbon atoms=50), hexacontanoic acid (number of carbon atoms=60), and octaheptacontanoic acid (number of carbon atoms=78), and by unsaturated fatty acids such as triacontenoic acid (number of carbon atoms=30), tetracontenoic acid (number of carbon atoms=40), pentacontanoic acid (number of carbon atoms=50), hexacontanoic acid (number of carbon atoms=60), and octaheptacontenoic acid (number of carbon atoms=78).

The aliphatic monoalcohol can be exemplified by saturated alcohols such as ceryl alcohol (number of carbon atoms=26), melissyl alcohol (number of carbon atoms=30), tetracontanol (number of carbon atoms=40), pentacontanol (number of carbon atoms=50), hexacontanol (number of carbon atoms=60), and octaheptacontanol (number of carbon atoms=78), and by unsaturated alcohols such as triacontenol (number of carbon atoms=30), tetracontenol (number of carbon atoms=40), pentacontanol (number of carbon atoms=50), hexacontenol (number of carbon atoms=60), and octaheptacontenol (number of carbon atoms=78).

The main peak molecular weight of the long-chain monomer is measured by gel permeation chromatography (GPC) as follows.

Special-grade 2,6-di-t-butyl-4-methylphenol (BHT) is added at a concentration of 0.10 mass % to chromatographic grade o-dichlorobenzene and is dissolved at room temperature. The sample and the BHT-containing o-dichlorobenzene are introduced into the sample vial and the sample is dissolved by heating on a hot plate set to 150° C. Once the sample has dissolved, it is introduced into the pre-heated filter unit and this is set into the main unit. The GPC sample is obtained by passage through the filter unit.

The sample solution is adjusted to give a concentration of approximately 0.15 mass %. The measurement is carried out under the following conditions using this sample solution.

instrumentation: HLC-8121GPC/HT (Tosoh Corporation)
detector: high-temperature RI
column: 2×TSKgel GMHHR-H HT (Tosoh Corporation)
temperature: 135.0° C.
solvent: chromatographic grade o-dichlorobenzene (with the addition of 0.10 mass % BHT)
flow rate: 1.0 mL/min
injection amount: 0.4 mL In order to calculate the main peak molecular weight of the long-chain monomer, a molecular weight calibration curve is used that is constructed using standard polystyrene resin (trade name: "TSK Standard Polystyrene F-850, F-450, F-288, F-128, F-80, F-40, F-20, F-10, F-4, F-2, F-1, A-5000, A-2500, A-1000, A-500", Tosoh Corporation).

The condensation of this long-chain monomer at a terminal of the polyester segment can bring about an improvement in the low-temperature fixability because this long-chain monomer undergoes orientation within the hybrid resin and melts in a prescribed temperature range.

The content of this long-chain monomer, as a ratio when the total amount of alcohol monomer (excluding the long-chain monomer) making up the polyester segment is made 100 mol %, is preferably from at least 0.1 mol % to not more than 20 mol %, more preferably from at least 1 mol % to not more than 15 mol %, and particularly preferably from at least 2 mol % to not more than 10 mol %.

The peak temperature of the cold crystallization peak during cooling in the DSC curve measured with a scanning differential calorimeter on the hybrid resin can be adjusted into the previously indicated range by controlling the number of carbon atoms in this long-chain monomer.

In addition, the peak temperature for the endothermic peak of the resin component can be adjusted into the previously indicated range by controlling the number of carbon atoms in the long-chain monomer and by controlling the monomer constituting the crystalline polyester.

In the production of the hybrid resin, preferably the long-chain monomer is added at the same time as the other monomer constituting the polyester segment and a condensation polymerization is then carried out. A thorough condensation of the long-chain monomer at the polyester segment terminal can be brought about by doing this. This results in a greater promotion of melting of the hybrid resin and an additional improvement in the low-temperature fixability. The simultaneous addition of the long-chain monomer is also preferred from the standpoint of eliminating long-chain monomer that is not bonded to the polyester segment. The long-chain monomer can be more uniformly dispersed in the toner particle by bringing about a stringent bonding of the long-chain monomer to the polyester segment. This results in an increase in the meltability of the hybrid resin in the prescribed temperature range and an improvement in the low-temperature fixability of the toner. When, on the other hand, the long-chain monomer is added in the latter half of the condensation polymerization reaction of the polyester segment, a satisfactory introduction of the long-chain monomer into the polyester segment does not occur and the long-chain monomer ends up being present in a free state in the hybrid resin. This may result in a lowering of the low-temperature fixability of the toner.

In addition to the previously indicated monovalent long-chain monomer, the monomer constituting the polyester segment of the hybrid resin used by the present invention can be exemplified by dihydric and trihydric alcohols and by bivalent and trivalent carboxylic acids and their anhydrides and lower alkyl esters.

The introduction of a partial crosslinking structure into the polyester segment is effective for the introduction of a structure in which the polyester segment has a branch chain, and this may be achieved by the use of a trifunctional or higher functional polyfunctional compound. For the present invention, thus, the trivalent or higher carboxylic acids and their anhydrides and lower alkyl esters and/or the trihydric or higher hydric alcohols can be used as the monomer constituting the polyester segment.

The bivalent carboxylic acids can be exemplified by maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, and isooctylsuccinic acid and the anhydrides and lower alkyl esters of these acids. The use is preferred among the preceding of maleic acid, fumaric acid, terephthalic acid, and n-dodecenylsuccinic acid.

The trivalent or higher carboxylic acids and their anhydrides and lower alkyl esters can be exemplified by 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid and the anhydrides and lower alkyl esters of the preceding. 1,2,4-benzenetricarboxylic acid, i.e., trimellitic acid, and its derivatives are particularly preferred among the preceding from the standpoints of low cost and ease of reaction control.

A single selection from these bivalent carboxylic acids and trivalent and higher carboxylic acids may be used in the present invention, or a plurality of selections may be used in combination.

The dihydric alcohol can be exemplified by alkylene oxide adducts of bisphenol A, e.g., polyoxypropylene(2.2)2,2-bis(4-hydroxyphenyl)propane, polyoxypropylene(3.3)2,2-bis(4-hydroxyphenyl)propane, polyoxyethylene(2.0)2,2-bis(4-hydroxyphenyl)propane, polyoxypropylene(2.0)polyoxyethylene(2.0)2,2-bis(4-hydroxyphenyl)propane, and polyoxypropylene(6)2,2-bis(4-hydroxyphenyl)propane, and also by ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, and hydrogenated bisphenol A. Preferred among the preceding are alkylene oxide adducts of bisphenol A, ethylene glycol, 1,2-propylene glycol, 1,3-propylene glycol, and neopentyl glycol. The trihydric or higher hydric alcohols can be exemplified by sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Preferred among the preceding are glycerol, trimethylolpropane, and pentaerythritol.

A single selection from these dihydric alcohols and trihydric and higher hydric alcohols may be used in the present invention, or a plurality of selections may be used in combination.

A catalyst as ordinarily used in polyesterification may be used as the catalyst for the production of the polyester segment, for example, metals such as tin, titanium, antimony, manganese, nickel, zinc, lead, iron, magnesium, calcium, and germanium, and compounds containing these metals (for example, dibutyltin oxide, ortho-dibutyl titanate, tetrabutyl titanate, zinc acetate, lead acetate, cobalt acetate, sodium acetate, and antimony trioxide).

Preferably at least styrene is used as the vinylic monomer used to produce the vinylic polymer segment of the hybrid resin. A large proportion of the molecular structure is taken up by the aromatic ring in the case of styrene, and it is advantageous from a design standpoint for increasing the stiffness·viscosity of the vinylic polymer segment. The styrene content in the vinylic monomer is preferably from at least 70 mol % to not more than 100 mol % and is more preferably from at least 85 mol % to not more than 100 mol %.

The non-styrene vinylic monomer used to produce the vinylic polymer segment can be exemplified by the following styrenic monomers and acrylic acid-type monomers.

The styrenic monomers can be exemplified by styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene.

The acrylic acid-type monomer can be exemplified by acrylic acid and acrylate esters, e.g., acrylic acid, methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; α-methylene aliphatic monocarboxylic acids and their esters, e.g., methacrylic acid, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and derivatives of acrylic acid and methacrylic acid, e.g., acrylonitrile, methacrylonitrile, and acrylamide.

The monomer for producing the vinylic polymer segment can also be exemplified by hydroxyl group-containing monomers, e.g., acrylate and methacrylate esters such as 2-hydroxylethyl acrylate, 2-hydroxylethyl methacrylate, and 2-hydroxylpropyl methacrylate, as well as 4-(1-hydroxy-1-methylbutyl)styrene and 4-(1-hydroxy-1-methylhexyl)styrene.

As necessary, various vinyl-polymerizable monomers may also be used in the vinylic polymer segment. These monomers can be exemplified by ethylenically unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the hemiesters of unsaturated dibasic acids, such as the methyl hemiester of maleic acid, the ethyl hemiester of maleic acid, the butyl hemiester of maleic acid, the methyl hemiester of citraconic acid, the ethyl hemiester of citraconic acid, the butyl hemiester of citraconic acid, the methyl hemiester of itaconic acid, the methyl hemiester of alkenylsuccinic acid, the methyl hemiester of fumaric acid, and the methyl hemiester of mesaconic acid; the esters of unsaturated dibasic acids, such as dimethyl maleate and dimethyl fumarate; the acid anhydrides of α,β-unsaturated acids such as acrylic acid, methacrylic acid, crotonic acid, and cinnamic acid; anhydrides between these α,β-unsaturated acids and lower fatty acids; and carboxyl group-containing monomers such as alkenylmalonic acid, alkenylglutaric acid, and alkenyladipic acid and their anhydrides and monoesters.

The vinylic polymer segment may optionally be a polymer that has been crosslinked with a crosslinking monomer as exemplified below. This crosslinking monomer can be exemplified by aromatic divinyl compounds, alkyl chain-linked diacrylate compounds, diacrylate compounds in which linkage is effected by an alkyl chain that contains an ether linkage, diacrylate compounds in which linkage is effected by a chain that has an aromatic group and an ether linkage, polyester-type diacrylates, and polyfunctional crosslinking agents. The aromatic divinyl compounds can be exemplified by divinylbenzene and divinylnaphthalene.

The above-referenced alkyl chain-linked diacrylate compounds can be exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds provided by replacing the acrylate in the preceding compounds with methacrylate.

The above-referenced diacrylate compounds in which linkage is effected by an alkyl chain that contains an ether linkage can be exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by replacing the acrylate in the preceding compounds with methacrylate.

The above-referenced diacrylate compounds in which linkage is effected by a chain that has an aromatic group and an ether linkage can be exemplified by polyoxyethylene(2)-2,2-bis(4-hydroxyphenyl)propane diacrylate, polyoxyethylene(4)-2,2-bis(4-hydroxyphenyl)propane diacrylate, and compounds provided by replacing the acrylate in the preceding compounds with methacrylate. The polyester-type diacrylates can be exemplified by MANDA (product name, from Nippon Kayaku Co., Ltd.).

The above-referenced multifunctional crosslinking agents can be exemplified by pentaerythritol triacrylate, trimethylolethane triacrylate, trimethylolpropane triacrylate, tetramethylolmethane tetraacrylate, oligoester acrylate, and compounds provided by replacing the acrylate in the preceding compounds with methacrylate, as well as by triallyl cyanurate and triallyl trimellitate.

The vinylic polymer segment may be a resin that has been produced using a polymerization initiator. Considering the efficiency, the polymerization initiator is preferably used at from at least 0.05 mass parts to not more than 10 mass parts per 100 mass parts of the monomer.

The polymerization initiator can be exemplified by 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-carbamoylazoisobutyronitrile, 2,2'-azobis(2,4,4-trimethylpentane), 2-phenylazo-2,4-dimethyl-4-methoxyvaleronitrile, 2,2'-azobis(2-methylpropane), ketone peroxides (e.g., methyl ethyl ketone peroxide, acetylacetone peroxide, cyclohexanone peroxide), 2,2-bis(t-butylperoxy)butane, t-butyl hydroperoxide, cumene hydroperoxide, 1,1,3,3-tetramethylbutyl hydroperoxide, di-t-butyl peroxide, t-butyl cumyl peroxide, dicumyl peroxide, α,α'-bis(t-butylperoxyisopropyl) benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxybenzoate, t-butylperoxy isopropyl carbonate, di-t-butyl peroxyisophthalate, t-butylperoxy allyl carbonate, t-amylperoxy 2-ethylhexanoate, di-t-butylperoxy hexahydroterephthalate, and di-t-butylperoxy azelate.

The hybrid resin referenced above is a resin in which the polyester segment is chemically bonded to the vinylic polymer segment. Due to this, the polymerization is preferably carried out using a compound (referred to below as a "dual reactive compound") capable of reacting with monomer that makes up each of the two segments, i.e., the polyester segment and the vinylic polymer segment. Among monomers that yield the polyester segment and monomers that yield the vinylic polymer segment, such dual reactive compounds can be exemplified by fumaric acid, acrylic acid, methacrylic acid, citraconic acid, maleic acid, and dimethyl fumarate. The use of fumaric acid, acrylic acid, and methacrylic acid among the preceding is preferred.

With regard to the method for obtaining the hybrid resin, this method can be exemplified by the simultaneous or sequential reaction of the monomer that gives the polyester segment, the long-chain monomer, and the monomer that gives the vinylic polymer segment. An embodiment preferred in the present invention because it supports facile control of the molecular weight is a production method in which an addition polymerization reaction is run on the monomer that forms the vinylic polymer segment, followed by the execution of a condensation polymerization reaction on the monomer that forms the polyester segment.

The content of the hybrid resin, expressed with reference to the resin component, is preferably from at least 50 mass % to not more than 90 mass % and is more preferably from at least 50 mass % to not more than 80 mass %.

The value provided by subtracting the peak temperature for the cold crystallization peak during cooling in the DSC curve measured with a differential scanning calorimeter for the hybrid resin, from the peak temperature for the cold crystallization peak during cooling in the DSC curve measured with a differential scanning calorimeter for the crystalline polyester resin, is in the present invention preferably from at least 10.0° C. to not more than 35.0° C. and more preferably from at least 10.0° C. to not more than 30.0° C.

According to investigations by the present inventors, it was found that, when two resin components are present that have different peak temperatures for the cold crystallization peak during cooling in the DSC curve measured with a differential scanning calorimetry in a prescribed temperature range as above, the two crystalline components undergo orientation so as to assume the crystalline structure of the main component and a single crystalline structure is assumed (such a crystalline structure is referred to as a eutectic structure in the present invention). When such a eutectic structure can be assumed, this makes it possible to freely control to a certain degree the peak temperature of the endothermic peak of the resin component and the peak temperature of the cold crystallization peak for the toner, and makes it particularly easy to effect control into the ranges stipulated for the present invention. The result is to facilitate the design of a toner that melts very rapidly upon receiving heat during fixing and that rapidly recrystallizes when the paper is ejected from the printer unit.

Viewed from the standpoint of the dispersibility with the hybrid resin and the ease of orientation in support of assuming a eutectic structure, the crystalline polyester resin in the present invention has a softening point, as measured using a constant-load extrusion-type capillary rheometer, preferably of from at least 70.0° C. to not more than 110.0° C. and more preferably from at least 70.0° C. to not more than 100.0° C.

Since facile molecular motion in support of assuming the eutectic structure is required, the crystalline polyester resin in the present invention is preferably a crystalline polyester resin that can assume a lamellar structure, which is a folded structure. It should be noted that crystalline compounds with a weight-average molecular weight of not more than 1,000 tend to produce fixing member contamination when such materials themselves undergo melting.

The crystalline polyester resin in the present invention preferably has a peak temperature for the endothermic peak in the DSC curve measured with a differential scanning calorimeter of from at least 50° C. to not more than 100° C.

The alcohol component used in the starting monomer for this crystalline polyester resin can be exemplified by ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-icosanediol, but there is no limitation to the preceding.

Among the preceding, $C_{6-18}$ aliphatic diols are preferred and $C_{8-14}$ aliphatic diols are more preferred from the standpoint of the fixing performance, the heat stability, and the ease of orientation in support of assuming a eutectic structure.

Viewed from the perspective of achieving an additional increase in the crystallinity of the crystalline polyester resin, the content of this aliphatic diol in the alcohol component is preferably from at least 80 mol % to not more than 100 mol %.

The alcohol component for obtaining the crystalline polyester resin may contain a polyhydric alcohol component in addition to the aliphatic diol referenced above. Examples here are aromatic diols such as alkylene oxide adducts of bisphenol A, including polyoxypropylene adducts of 2,2-bis(4-hydrophenyl)propane and polyoxyethylene adducts of 2,2-bis(4-hydroxyphenyl)propane, and also trihydric or higher hydric alcohols such as glycerol, pentaerythritol, and trimethylolpropane.

The carboxylic acid component used in the starting monomer for the crystalline polyester resin, on the other hand, can be exemplified by aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid, and also by their anhydrides and lower alkyl esters.

Viewed from the standpoints of the fixing performance, the heat stability, achieving an even higher crystallinity, and the ease of orientation in support of assuming a eutectic structure, the use of $C_{6-18}$ aliphatic dicarboxylic acid compounds is preferred while $C_{6-12}$ aliphatic dicarboxylic acid compounds are more preferred. The content of this aliphatic dicarboxylic acid compound in the carboxylic acid component is preferably from at least 80 mol % to not more than 100 mol %.

The carboxylic acid component for obtaining the crystalline polyester resin may contain a carboxylic acid component other than the aliphatic dicarboxylic acid compounds described above. Examples in this regard are aromatic dicarboxylic acid compounds and trivalent or higher aromatic polyvalent carboxylic acid compounds, but there is no particular limitation to these. The aromatic dicarboxylic acid compounds here also encompass aromatic dicarboxylic acid derivatives. Preferred specific examples of the aromatic dicarboxylic acid compound are aromatic dicarboxylic acids such as phthalic acid, isophthalic acid, terephthalic acid, and naphthalene-2,6-dicarboxylic acid, and the anhydrides of these acids and their alkyl (from 1 to 3 carbons) esters. The alkyl group in the alkyl ester can be exemplified by the methyl group, ethyl group, propyl group, and isopropyl group. The trivalent or higher polyvalent carboxylic acid compounds can be exemplified by derivatives such as aromatic carboxylic acids including 1,2,4-benzenetricarboxylic acid (trimellitic acid), 2,5,7-naphthalenetricarboxylic acid, and pyromellitic acid and by their acid anhydrides and alkyl (from 1 to 3 carbons) esters.

The molar ratio between the carboxylic acid component and the alcohol component that are the starting monomers for the crystalline polyester resin (carboxylic acid component/alcohol component) is preferably from at least 0.80 to not more than 1.20.

In addition, from the perspective of the fixing performance and heat-resistant storage stability, the weight-average molecular weight (Mw) of the crystalline polyester resin is preferably from at least 8,000 to not more than 100,000 and is more preferably from at least 12,000 to not more than 45,000.

The content of the crystalline polyester resin, expressed with reference to the resin component, is preferably from at least 2 mass % to not more than 10 mass % and more preferably from at least 2 mass % to not more than 7.5 mass %.

The resin component in the present invention may contain, to the extent that the effects of the present invention are not impaired, a resin other than the hybrid resin and crystalline polyester resin that have been described in the preceding. The binder resins for application in toners can be used without particular limitation as this other resin, and examples in this regard are polyester resins other than the crystalline polyester described in the preceding, vinyl-type resins, polyurethane resins, epoxy resins, and phenolic resins. In an embodiment preferred from the standpoint of improving the dispersibility of the crystalline polyester, a polyester resin other than the previously described crystalline polyester is used that is a low molecular weight resin having a weight-average molecular weight (Mw) of approximately from at least 2,000 to not more than 7,000. Such a polyester resin may be added at approximately 20 mass % to 50 mass % (amount of addition) with reference to the resin component.

The toner of the present invention may be a magnetic toner or may be a nonmagnetic toner.

Magnetic iron oxide is preferably used when the toner of the invention is used in the form of a magnetic toner. Iron oxides such as magnetite, maghemite, and ferrite can be used as the magnetic iron oxide. With the goal of bringing about an increase in the microdispersibility of the magnetic iron oxide in the toner particles, the magnetic iron oxide is preferably subjected to a deagglomeration treatment by applying shear to the slurry during production.

The amount of magnetic iron oxide incorporated in the toner in the present invention is preferably from at least 25 mass % to not more than 45 mass % in the toner and is more preferably from at least 30 mass % to not more than 45 mass %.

These magnetic iron oxides have the following magnetic properties under the application of 795.8 kA/m: a coercive force of from at least 1.6 kA/m to not more than 12.0 kA/m and a saturation magnetization of from at least 50.0 $Am^2/kg$ to not more than 200.0 $Am^2/kg$ (preferably from at least 50.0 $Am^2/kg$ to not more than 100.0 $Am^2/kg$). The residual magnetization is preferably from at least 2.0 $Am^2/kg$ to not more than 20.0 $Am^2/kg$.

The magnetic properties of magnetic iron oxides can be measured using a vibrating magnetometer, for example, the VSM P-1-10 (from Toei Industry Co., Ltd.).

When, on the other hand, the toner of the present invention is used in the form of a nonmagnetic toner, as necessary a carbon black and/or one or two or more of the heretofore known so-called pigments and dyes can be used as a colorant. Per 100.0 mass parts of the resin component, the amount of colorant addition is preferably from at least 0.1 mass parts to not more than 60.0 mass parts and more preferably is from at least 0.5 mass parts to not more than 50.0 mass parts.

A release agent (wax) may optionally be used in the present invention in order to impart releasability to the toner. Viewed in terms of the ease of dispersion in the toner and the extent of the releasability, this wax is preferably a hydrocarbon wax such as low molecular weight polyethylene, low molecular weight polypropylene, microcrystalline wax, or paraffin wax. The following are examples of hydrocarbon waxes: low molecular weight alkylene polymers provided by the radical polymerization of an alkylene under high pressures or provided by polymerization at low pressures using a Ziegler catalyst; alkylene polymers obtained by the pyrolysis of high molecular weight alkylene polymer; synthetic hydrocarbon waxes obtained from the residual distillation fraction of hydrocarbon obtained by the Arge method from a synthesis gas containing carbon monoxide and hydrogen, and also the synthetic hydrocarbon waxes obtained by the hydrogenation of the former synthetic hydrocarbon waxes; and waxes provided by the fractionation of these aliphatic hydrocarbon waxes by a press sweating method, solvent method, use of vacuum distillation, or a fractional crystallization technique.

The following are examples of the hydrocarbon that can be used as the source for the aliphatic hydrocarbon wax: hydrocarbon synthesized by the reaction of carbon monoxide and hydrogen using a metal oxide catalyst (frequently a multicomponent system that is a binary or higher system) (for example, hydrocarbon compounds synthesized by the Synthol method or Hydrocol method (use of a fluidized catalyst bed)); hydrocarbon having up to about several hundred carbons, obtained by the Arge method, which produces large amounts of waxy hydrocarbon (use of a fixed catalyst bed); and hydrocarbon provided by the polymerization of an alkylene, e.g., ethylene, using a Ziegler catalyst. Among these hydrocarbons, a saturated, long-chain, straight-chain hydrocarbon having at least little branching is preferred in the present invention. In particular, hydrocarbon synthesized by a method that does not depend on alkylene polymerization is also preferred for its molecular weight distribution. One or two or more of the following waxes may as necessary also be co-used:

oxides of aliphatic hydrocarbon waxes, such as oxidized polyethylene wax, and their block copolymers; waxes in which the major component is fatty acid ester, such as carnauba wax, sasol wax, and montanoic acid ester waxes; waxes provided by the partial or complete deacidification of fatty acid esters, such as deacidified carnauba wax; saturated straight-chain fatty acids such as palmitic acid, stearic acid, and montanoic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters between a polyhydric alcohol and a fatty acid, such as behenic monoglyceride; and hydroxyl group-containing methyl ester compounds obtained by the hydrogenation of plant oils.

Specific examples are as follows: VISKOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, C77 (Schumann Sasol AG); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Petrolite Co., Ltd.); and Japan Wax, Beeswax, Rice Wax, Candelilla Wax, and Carnauba Wax (available at Cerarica NODA Co., Ltd.).

With regard to the timing of release agent addition, it may be added during melt kneading during toner production or during production of the hybrid resin, and a suitable selection from existing methods can be used. Moreover, a single one of these release agents may be used or combinations may be used.

The release agent is preferably added at from at least 1 mass parts to not more than 20 mass parts per 100 mass parts of the resin component.

A charge control agent can be used in the toner of the present invention in order to stabilize its charging characteristics. While the charge control agent content will also vary as a function of its type and the properties of the other materials that make up the toner particles, it is generally preferably from at least 0.1 mass parts to not more than 10 mass parts per 100 mass parts of the resin component in the toner particles, while from at least 0.1 mass parts to not more than 5 mass parts is more preferred.

Organometal complexes and chelate compounds, whose central metal readily interacts with the acid group or hydroxyl group present at the terminals of the hybrid resin used by the present invention, are effective as this charge control agent. Examples here are monoazo metal complexes, acetylacetone metal complexes, and the metal complexes and metal salts of aromatic hydroxycarboxylic acids and aromatic dicarboxylic acids.

Specific examples are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.). A charge control resin may also be used in combination with these charge control agents.

With the goal of improving the flowability of the toner, a flowability improver with a BET specific surface area of from at least 50 $m^2/g$ to not more than 300 $m^2/g$ is preferably added as an external additive to the toner particles in the toner of the present invention.

Any flowability improver can be used that, through its external addition to the toner particles, can increase the flowability when a pre-versus-post-addition comparison is made. Examples are as follows: finely divided fluororesin powders, e.g., finely divided vinylidene fluoride powders and finely divided polytetrafluoroethylene powders; finely divided silica powders such as wet silica and dry silica; and the treated silicas provided by subjecting these silicas to a surface treatment with, for example, a silane coupling agent, titanium coupling agent, or silicone oil. Preferred flowability improvers among the preceding are the finely divided powders produced by the vapor-phase oxidation of a silicon halide compound, or a so-called dry silica or fumed silica. This utilizes, for example, the thermal degradation and oxidation reaction of silicon tetrachloride gas in oxygen and hydrogen, and the reaction equation is as follows.

$$SiCl_4+2H_2+O_2 \rightarrow SiO_2+4HCl$$

In addition, a finely divided composite powder of silica and another metal oxide may also be obtained in this production process by the use, in combination with the silicon halide compound, of another metal halide compound such as aluminum chloride or titanium chloride. Its particle diameter, as the average primary particle diameter, is preferably in the range from at least 0.001 μm to not more than 2 μm, while the use is particularly preferred of a finely divided silica powder in the range from at least 0.002 μm to not more than 0.2 μm.

The use is even more preferred of a treated finely divided silica powder as provided by carrying out a hydrophobic treatment on the finely divided silica powder produced by the vapor-phase oxidation of a silicon halide compound. A particularly preferred treated finely divided silica powder is provided by treatment of a finely divided silica powder so as to obtain a value in the range from at least 30 to not more than 80 for the titrated hydrophobicity according to the methanol titration test.

The hydrophobing method is carried out by a chemical treatment with an organosilicon compound that reacts with or physically adsorbs to the finely divided silica powder. In a preferred method, a finely divided silica powder produced by the vapor-phase oxidation of a silicon halide compound is treated with an organosilicon compound. This organosilicon compound is exemplified by the following: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and dimethylpolysiloxanes that have from 2 to 12 siloxane units per molecule and that have one hydroxyl group on the Si at each unit in terminal position. A single one of these may be used or a mixture of two or more may be used.

These finely divided silica powders may be treated with a silicone oil or may be treated using the previously described hydrophobic treatment in addition thereto.

A silicone oil is preferably used that has a viscosity at 25° C. of from at least 30 $mm^2/s$ to not more than 1000 $m^2/s$. For example, dimethylsilicone oils, methylphenylsilicone oils, α-methylstyrene-modified silicone oils, chlorophenylsilicone oils, and fluorine-modified silicone oils are particularly preferred.

The method for carrying out the silicone oil treatment can be exemplified by the following methods: methods in which the silicone oil and the finely divided silica powder, which has already been treated with a silane coupling agent, are directly mixed using a mixer such as a Henschel mixer; methods in which the silicone oil is sprayed on the finely divided silica powder that forms the base; and methods in which the silicone oil is dissolved or dispersed in a suitable solvent, the finely divided silica powder is added and mixing is carried out, and the solvent is removed. The coating on the surface of the silicone oil-treated silica is more preferably stabilized by heating the silica, after its treatment with silicone oil, to a temperature of at least 200° C. (more preferably at least 250° C.) in an inert gas.

Hexamethyldisilazane (HMDS) is an example of a preferred silane coupling agent.

The following treatments are preferred for the present invention: a method in which the finely divided silica powder is treated in advance with a coupling agent and is thereafter treated with a silicone oil; a method in which the finely divided silica powder is treated simultaneously with a coupling agent and a silicone oil.

Other external additives may also be added to the toner of the present invention on an optional basis. Examples in this regard are auxiliary charging agents, agents that impart electroconductivity, anti-caking agents, lubricants, and finely divided resin particles and finely divided inorganic particles that function as an abrasive.

The lubricant can be exemplified by polyethylene fluoride powders, zinc stearate powders, and polyvinylidene fluoride powders. Polyvinylidene fluoride powder is preferred thereamong. The abrasive can be exemplified by cerium oxide powders, silicon carbide powders, and strontium titanate powders. These external additives can be added, for example, by admixing using a mixer such as a Henschel mixer.

The amount of external additive addition, expressed per 100 mass parts of the toner particles, is preferably from at least 0.01 mass parts to not more than 8 mass parts and more preferably from at least 0.1 mass parts to not more than 4 mass parts.

The method of producing the toner of the present invention can be exemplified by the following method: the resin component and optional colorant, release agent, and other additives are thoroughly mixed with a mixer such as a Henschel mixer or ball mill; this is followed by melt kneading using a heated kneader such as a hot roll, kneader, or extruder; cooling and solidification are carried out followed by pulverization and classification; and the toner of the present invention is then produced by thoroughly mixing any optional desired additives in a mixer such as a Henschel mixer. However, this is not meant to imply a limitation to this production method. The kneader used in the melt kneading is preferably a twin-screw extruder because, for example, this enables continuous production.

The methods for measuring the properties pertaining to the toner of the present invention are shown in the following. The examples provided later are also based on these methods.

<Measurement of the Glass Transition Temperature>

The glass transition temperature of the toner and hybrid resin is measured in the present invention based on ASTM D 3418-82 using a "Q1000" differential scanning calorimeter (TA Instruments). Temperature correction of the instrument detection section uses the melting points of indium and zinc, while the heat of fusion of indium is used to correct the amount of heat.

Specifically, approximately 5 mg of the measurement sample is precisely weighed out and placed in an aluminum pan. Using an empty aluminum pan as the reference, measurement is carried out at normal temperature and normal humidity using a ramp rate of 10° C./minute over the measurement temperature interval of from at least 30° C. to not more than 200° C. In the measurement, the temperature is raised to 200° C. and then reduced to 30° C. With the DSC curve obtained by raising measurement temperature, the glass transition temperature is taken to be the intersection between the differential heat curve and the line (i.e., the straight line equidistant in the vertical axis direction from the straight lines that extend each baseline) for the midpoint between the baseline prior to the appearance of the specific heat change and the baseline after the appearance of the specific heat change.

<Measurement of the Peak Temperature at the Cold Crystallization Peak During Cooling, the Peak Temperature of the Endothermic Peak, and the Endothermic Quantity for the Endothermic Peak>

The peak temperature at the cold crystallization peak during cooling of the toner, hybrid resin, or crystalline polyester resin, the peak temperature of the endothermic peak for the resin component, and the endothermic quantity for the endothermic peak are measured based on ASTM D 3418-82 using a "Q1000" differential scanning calorimeter (TA Instruments). Temperature correction of the instrument detection section uses the melting points of indium and zinc, while the heat of fusion of indium is used to correct the amount of heat.

Specifically, approximately 5 mg of the measurement sample is precisely weighed out and placed in an aluminum pan. Using an empty aluminum pan as the reference, measurement is carried out at normal temperature and normal humidity using a ramp rate of 10° C./minute over the measurement temperature interval of from at least 30° C. to not more than 200° C. Once the temperature has been raised to 200° C. in the measurement, cooling is then carried out to 30° C. at a rate of 10° C./min, followed by reheating. The temperature of the peak top of the endothermic peak in the temperature interval from at least 30° C. to not more than 200° C. in the DSC curve obtained by raising measurement temperature (that is, in the first heating step) is taken to be the peak temperature of the endothermic peak. The endothermic quantity (ΔH) is the integration value (J/g) for this endothermic peak.

The peak temperature at the cold crystallization peak during cooling is taken to be the temperature of the peak top of the exothermic peak in the temperature interval from at least 30° C. to not more than 200° C. in the DSC curve obtained by lowering measurement temperature (that is, in the cooling step). The method for identifying what components each peak derives from is as follows: extraction is carried out with a solvent that corresponds to the peak temperature (for example, methyl ethyl ketone) and compositional analysis is carried out using pyrolysis GC-Mass and infrared spectrophotometry (IR).

<Measurement of the Tetrahydrofuran (THF)-Insoluble Matter for the Hybrid Resin>

The THF-insoluble matter originating with the hybrid resin is measured by the following method.

Approximately 2.0 g of the toner is weighed out (W1, g) and is introduced into a cylindrical filter paper (No. 86R, size 28×100 mm, from Toyo Roshi Kaisha, Ltd.) and this is installed in a Soxhlet extractor and extraction is carried out for 16 hours using 200 mL THF for the solvent. The extraction is performed at a reflux rate that provides a solvent extraction cycle of once in approximately 4 minutes. After the completion of extraction, the cylindrical filter paper is removed; vacuum drying is carried out for 8 hours at 40° C.; and the amount of extraction residue is then weighed (W2, g). The weight of the incineration ash content (W3, g) in the toner is then determined. The incineration ash content is determined by the following procedure. The mass (Wa, g) of the sample is exactly weighed by placing approximately 2 g of the sample in a pre-weighed 30 mL porcelain crucible and weighing. The crucible is placed in an electric oven and heated for about 3 hours at about 900° C., and is allowed to cool in the electric oven and for at least 1 hour in a desiccator at normal temperature and the mass of the crucible is weighed exactly. The incineration ash content (Wb, g) is determined from this.

$$\text{incineration ash content percentage (mass \%)} = (Wb/Wa)\times 100$$

The mass (W3, g) of the incineration ash content of the sample is determined from this percentage.

The THF-insoluble matter (%) is determined using the following formula.

$$\text{THF-insoluble matter (\%)} = [W2-W3]/[W1-W3]\times 100$$

To measure the THF-insoluble matter of a sample that does not contain components other than a resin such as the hybrid resin, the extraction residue (W2, g) is determined by the same procedure as above on the resin weighed out in the prescribed amount (W1, g) and the THF-insoluble matter is determined using the following formula.

$$\text{THF-insoluble matter (\%)} = W2/W1\times 100$$

<Measurement of the Molecular Weight Distribution by Gel Permeation Chromatography (GPC)>

The column is stabilized in a 40° C. heated chamber; tetrahydrofuran (THF) is passed through the column at this temperature at a flow rate of 1 mL/minute; and approximately 100 μL of the THF sample solution is injected to carry out the measurement. In the molecular weight measurement on the sample, the molecular weight distribution of the sample is determined from the relationship between the logarithmic value and the counts on a calibration curve constructed using several monodisperse polystyrene reference samples. The reference polystyrene samples used to construct the calibration curve are obtained from Tosoh Corporation or Showa Denko Kabushiki Kaisha and have molecular weights from about $1\times10^2$ to $1\times10^7$, and reference polystyrene samples at about at least 10 points are used. An RI (refractive index) detector is used for the detector. The column is preferably a combination of a plurality of commercially available polystyrene gel columns, and the combination of Shodex GPC KF-801, 802, 803, 804, 805, 806, 807, and 800P from Showa Denko Kabushiki Kaisha or the combination of TSKgel G1000H ($H_{XL}$), G2000H ($H_{XL}$), G3000H ($H_{XL}$), G4000H ($H_{XL}$), G5000 ($H_{XL}$), G6000H ($H_{XL}$), G7000H ($H_{XL}$), and TSKguard columns from Tosoh Corporation is used. The sample (resin) is prepared as follows.

The sample is placed in THF and, after standing for several hours at 25° C., is thoroughly shaken and the THF is thoroughly stirred (until the sample aggregate is not present), and this is followed by standing at quiescence for at least an additional 12 hours. The standing time in THF is brought to 24 hours at this point. This is followed by passage through a sample treatment filter (for example, a MyShoriDisk H-25-2 with a pore size of from at least 0.2 μm to not more than 0.5 μm (from Tosoh Corporation) can be used) to provide the GPC sample. The sample concentration is adjusted to provide a resin component of from at least 0.5 mg/mL to not more than 5 mg/mL.

<Measurement of the Weight-Average Particle Diameter (D4) of the Toner>

The weight-average particle diameter (D4) of the toner is calculated using a "Coulter Counter Multisizer 3" (registered trademark of Beckman Coulter, Inc.), which is a precision particle size distribution analyzer that uses the pore electrical resistance method and is equipped with a 100 μm aperture tube, and using the "Beckman Coulter Multisizer 3 Version 3.51" dedicated software (from Beckman Coulter, Inc.) provided with the instrument for setting the measurement conditions and performing measurement data analysis, to perform measurements at 25,000 channels for the number of effective measurement channels and to carry out analysis of the measurement data.

A solution of special-grade sodium chloride dissolved in ion-exchanged water and brought to a concentration of approximately 1 mass %, for example, "ISOTON II" (Beckman Coulter, Inc.), can be used for the aqueous electrolyte solution used for the measurement.

The dedicated software is set as follows prior to running the measurement and analysis.

On the "Change Standard Operating Method (SOM)" screen of the dedicated software, the total count number for the control mode is set to 50,000 particles, the number of measurements is set to 1, and the value obtained using "10.0 μm standard particles" (from Beckman Coulter, Inc.) is set for the Kd value. The threshold value and noise level are automatically set by pressing the threshold value/noise level measurement button. The current is set to 1600 μA, the gain is set to 2, the electrolyte solution is set to ISOTON II, and "flush aperture tube after measurement" is checked.

On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the above-described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the dedicated software.

(2) Approximately 30 mL of the above-described aqueous electrolyte solution is introduced into a glass 100-mL flatbottom beaker. To this is added the following as a dispersing agent: approximately 0.3 mL of a dilution prepared by diluting "Contaminon N" (a 10 mass % aqueous solution of a neutral pH 7 detergent for cleaning precision measurement instrumentation, comprising a nonionic surfactant, an anionic surfactant, and an organic builder, from Wako Pure Chemical Industries, Ltd.) approximately 3-fold on a mass basis with ion-exchanged water.

(3) A prescribed amount of ion-exchanged water is introduced into the water tank of an "Ultrasonic Dispersion System Tetora 150" ultrasound disperser (Nikkaki Bios Co., Ltd.), which has an output of 120 W and is equipped with two oscillators oscillating at 50 kHz and configured with a phase shift of 180°, and approximately 2 mL of the above-described Contaminon N is added to this water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. but no more than 40° C.

(6) Using a pipette, the aqueous electrolyte solution from (5) containing dispersed toner is added dropwise into the roundbottom beaker of (1) that is installed in the sample stand and the measurement concentration is adjusted to approximately 5%. The measurement is run until the number of particles measured reaches 50.000.

(7) The measurement data is analyzed by the dedicated software provided with the instrument to calculate the weight-average particle diameter (D4). When the dedicated software is set to graph/volume %, the "average diameter" on the analysis/volume statistics (arithmetic average) screen is the weight-average particle diameter (D4).

<Measurement of the Magnetic Properties of the Magnetic Iron Oxide>

The measurement is carried out at an external magnetic field of 795.8 kA/m and a sample temperature of 25° C. using a VSM-P7 vibrating sample magnetometer from Toei Industry Co., Ltd.

<Measurement of the Number-Average Particle Diameter of the Primary Particles of the Magnetic Iron Oxide>

For the number-average particle diameter of the primary particles of the magnetic iron oxide, the magnetic iron oxide is observed with a scanning electron microscope (amplification=40,000×) and the number-average particle diameter is determined by measuring the Feret diameter of 200 particles. An S-4700 (Hitachi, Ltd.) was used as the scanning electron microscope.

<Measurement of the Softening Point>

Measurement of the softening point of the toner, hybrid resin, or crystalline polyester resin is performed according to the manual provided with the instrument, using a "Flowtester CFT-500D Flow Property Evaluation Instrument", a constant-load extrusion-type capillary rheometer from Shimadzu. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature is obtained from this.

The "melting temperature by the ½ method", as described in the manual provided with the "Flowtester CFT-500D Flow Property Evaluation Instrument", is used as the softening point in the invention. The melting temperature by the ½ method is determined as follows. Letting Smax be the piston stroke at the completion of outflow and Smin be the piston stroke at the start of outflow, ½ of the difference between Smax and Smin is determined to give the value X (X=(Smax−

Smin)/2). The temperature of the flow curve when the piston stroke in the flow curve reaches the sum of X and Smin is the melting temperature by the ½ method.

The measurement sample is prepared by subjecting 1.0 g of the sample to compression molding for approximately 60 seconds at approximately 10 MPa in a 25° C. atmosphere using a tablet compression molder (for example, the NT-100H from NPa System Co., Ltd.) to provide a cylindrical shape with a diameter of approximately 8 mm.

The measurement conditions with the CFT-500D are as follows.

test mode: rising temperature method
ramp rate: 4° C./min
start temperature: 50° C.
saturated temperature: 200° C.
measurement interval: 1.0° C.
piston cross section area: 1.000 $cm^2$
test load (piston load): 10.0 kgf (0.9807 MPa)
preheating time: 300 seconds
diameter of die orifice: 1.0 mm
die length: 1.0 mm

EXAMPLES

The basic structure and characteristics of the present invention are described hereinabove, and the present invention is specifically described herebelow based on examples. However, these in no way limit the embodiments of the present invention. Unless specifically indicated otherwise, parts and % in the examples and comparative examples are in all cases on a mass basis.

Resin 1 Production Example

Formulation of the Polyester (PES) Segment (P-1)

bisphenol A/ethylene oxide (2.2 mol adduct): 5.0 mol %
bisphenol A/propylene oxide (2.2 mol adduct): 95.0 mol %
terephthalic acid: 50.0 mol %
trimellitic anhydride: 24.0 mol %
acrylic acid: 10.0 mol %
secondary aliphatic saturated monohydric alcohol having a peak value for the number of carbon atoms of 70: 5.0 mol %

70 mass parts of this polyester monomer mixture is introduced into a four-neck flask; a pressure reduction apparatus, water separator, nitrogen gas introduction apparatus, temperature measurement apparatus, and stirring apparatus are installed; and stirring is performed at 160° C. under a nitrogen atmosphere. To this were added dropwise 30 mass parts of a vinylic copolymer monomer ([S-1], 60.0 mol % styrene and 40.0 mol % 2-ethylhexyl acrylate) that will constitute the vinylic polymer segment and 1 mass parts of benzoyl peroxide as polymerization initiator from a dropping funnel over 4 hours and a reaction was carried out for 5 hours at 160° C.

The temperature was subsequently raised to 230° C.; 0.2 mass parts of dibutyltin oxide was added with reference to the total amount (100 mass parts) of the polyester monomer component; and a condensation polymerization reaction was run for 6 hours. After the completion of the reaction, removal from the vessel, cooling, and pulverization yielded a resin 1. The properties of this resin 1 are given in Table 3.

Resins 2 to 9 Production Examples

Resins 2 to 9 were obtained in accordance with the Resin 1 Production Example, but using the monomers given in Tables 1 and 2 and changing to the amounts of addition given in Table 3. The properties of resins 2 to 9 are given in Table 3.

Resin 10 Production Example bisphenol A/ethylene oxide (2.2 mol adduct): 40.0 mol %
bisphenol A/propylene oxide (2.2 mol adduct): 60.0 mol %
terephthalic acid: 77.0 mol %

This monomer and 0.2 mass parts of dibutyltin oxide with reference to the total amount of this monomer (100 mass parts) were introduced into a 10-L four-neck flask fitted with a nitrogen inlet tube, water separator, stirrer, and thermocouple; a reaction was run for 4 hours at 180° C.; the temperature was then raised to 210° C. at a ramp rate of 10° C./hour and was held at 210° C. for 8 hours; and resin 10 was then obtained by reacting for 1 hour at 8.3 kPa. The properties of resin 10 are given in Table 3.

Crystalline Polyester Resin (CP-1) Production Example 1,10-decanediol: 100.0 mol parts
1,10-decanedicarboxylic acid: 100.0 mol parts This monomer and 0.2 mass parts of dibutyltin oxide with reference to the total amount of this monomer (100 mass parts) were introduced into a 10-L four-neck flask fitted with a nitrogen inlet tube, water separator, stirrer, and thermocouple; a reaction was run for 4 hours at 180° C.; the temperature was then raised to 210° C. at 10° C./hour and was held at 210° C. for 8 hours; and crystalline polyester resin (CP-1) was then obtained by reacting for 1 hour at 8.3 kPa. The properties of crystalline polyester resin (CP-1) are given in Table 4.

Crystalline Polyester Resins (CP-2) to (CP-5) Production Examples

Crystalline polyester resins (CP-2) to (CP-5) were obtained proceeding as in Crystalline Polyester Resin (CP-1) Production Example, but using the monomers indicated in Table 4. The properties of these resins are given in Table 4.

TABLE 1

Resin composition table (PES segment)

| | BPA-PO (mol %) | BPA-EO (mol %) | DSA (mol %) | TPA (mol %) | TMA (mol %) | Acrylic acid (mol %) | Type of long-chain monomer | Number of carbon atoms in the long-chain monomer | Amount of long-chain monomer addition (mol %) |
|---|---|---|---|---|---|---|---|---|---|
| P-1 | 95.0 | 5.0 | — | 50.0 | 24.0 | 10.0 | saturated monohydric secondary alcohol | 70 | 5.0 |
| P-2 | 0.0 | 100.0 | — | 60.0 | 20.0 | 10.0 | saturated monohydric secondary alcohol | 70 | 5.0 |
| P-3 | 95.0 | 5.0 | — | 50.0 | 18.0 | 10.0 | saturated monohydric secondary alcohol | 70 | 5.0 |
| P-4 | 0.0 | 100.0 | — | 60.0 | 20.0 | 10.0 | saturated monohydric primary alcohol | 30 | 5.0 |
| P-5 | 0.0 | 100.0 | — | 60.0 | 20.0 | 10.0 | — | — | — |
| P-6 | 0.0 | 100.0 | — | 60.0 | 20.0 | 10.0 | saturated monohydric primary alcohol | 20 | 5.0 |
| P-7 | 0.0 | 100.0 | — | 60.0 | 20.0 | 10.0 | saturated monohydric secondary alcohol | 70 | 10.0 |
| P-8 | 0.0 | 100.0 | — | 60.0 | 20.0 | 10.0 | saturated monohydric primary alcohol | 50 | 5.0 |
| P-9 | 60.0 | 40.0 | 5.0 | 65.0 | 20.0. | 10.0 | — | — | — |
| P-10 | 60.0 | 40.0 | — | 77.0 | — | — | — | — | — |

BPA-PO: propylene oxide adduct of bisphenol A
BPA-EO: ethylene oxide adduct of bisphenol A
DSA: dodecenylsuccinic acid
TPA: terephthalic acid
TMA: trimellitic anhydride
*1 The mol % for the monomer in the table represents the percentage when the total amount of the alcohol component (excluding the long-chain monomer) is made 100 mol %.

In Table 1, the long-chain monomer used in P-1, P-2, P-3, and P-7 is an aliphatic saturated monohydric secondary alcohol having a peak value for the number of carbon atoms of 70; the long-chain monomer used in P-4 is an aliphatic saturated monohydric primary alcohol having a peak value for the number of carbon atoms of 30; the long-chain monomer used in P-6 is an aliphatic saturated monohydric primary alcohol having a peak value for the number of carbon atoms of 20; and the long-chain monomer used in P-8 is an aliphatic saturated monohydric primary alcohol having a peak value for the number of carbon atoms of 50.

TABLE 2

Resin composition table (vinylic polymer segment)

| | St (mol %) | 2EHA (mol %) |
|---|---|---|
| S-1 | 60.0 | 40.0 |
| S-2 | 100.0 | 0 |
| S-3 | 90.0 | 10.0 |
| S-4 | 100.0 | 0 |
| S-5 | 90.0 | 10.0 |
| S-6 | 100.0 | 0 |
| S-7 | 80.0 | 20.0 |
| S-8 | 100.0 | 0 |
| S-9 | 60.0 | 40.0 |

St: styrene
2EHA: 2-ethylhexyl acrylate
*1 The mol % for the monomer in the table represents the percentage when the total amount of the StAc component (excluding the long-chain monomer) is made 100 mol %.

TABLE 3

Formulation and properties of the resin components

| | PES segment/ amount of addition (mass parts) | Vinylic polymer segment/ amount of addition (mass parts) | Amount of initiator (mass parts) | Glass transition temperature (° C.) | Peak temperature for the cold crystallization peak (° C.) | Softening point (° C.) | Amount of the THF-insoluble matter (%) | Mpt | Mwt |
|---|---|---|---|---|---|---|---|---|---|
| resin 1 | P-1/70 | S-1/30 | 1.0 | 61.0 | 54.0 | 130.0 | 17.0 | 7350 | $2.21 \times 10^4$ |
| resin 2 | P-2/60 | S-2/40 | 1.0 | 60.9 | 52.0 | 130.0 | 20.0 | 7150 | $3.70 \times 10^4$ |
| resin 3 | P-3/60 | S-3/40 | 1.0 | 59.7 | 54.0 | 120.0 | 12.0 | 8520 | $3.71 \times 10^4$ |
| resin 4 | P-4/60 | S-4/40 | 1.0 | 61.2 | 61.8 | 125.0 | 17.4 | 7100 | $2.05 \times 10^4$ |
| resin 5 | P-5/60 | S-5/40 | 1.0 | 65.0 | — | 130.0 | 25.0 | 6850 | $1.98 \times 10^4$ |
| resin 6 | P-6/60 | S-6/40 | 1.0 | 55.2 | — | 130.0 | 5.4 | 6320 | $1.88 \times 10^4$ |
| resin 7 | P-7/60 | S-7/40 | 1.5 | 50.2 | 52.0 | 115.0 | 10.2 | 8900 | $5.21 \times 10^4$ |
| resin 8 | P-8/60 | S-8/40 | 0.5 | 61.2 | 63.2 | 125.0 | 12.0 | 8620 | $5.40 \times 10^4$ |

TABLE 3-continued

| Formulation and properties of the resin components | | | | | | | | | |
|---|---|---|---|---|---|---|---|---|---|
| | PES segment/ amount of addition (mass parts) | Vinylic polymer segment/ amount of addition (mass parts) | Amount of initiator (mass parts) | Glass transition temperature (° C.) | Peak temperature for the cold crystallization peak (° C.) | Softening point (° C.) | Amount of the THF-insoluble matter (%) | Mpt | Mwt |
| resin 9 | P-9/80 | S-9/20 | 0.5 | 58.5 | — | 115.0 | 23.0 | 8430 | $4.81 \times 10^4$ |
| resin 10 | P-10/100 | — | — | 58.5 | — | 90.0 | 0 | 6700 | 7800 |

TABLE 4

| Formulation and properties of the resin component | | | | | | | |
|---|---|---|---|---|---|---|---|
| | alcohol component | molar ratio | acid component | molar ratio | Peak temperature for the cold crystallization peak (° C.) | Softening point (° C.) | Peak temperature for the endothermic peak (° C.) |
| CP-1 | 1,10-decanediol | 100.0 | 1,10-decanedicarboxylic acid | 100.0 | 56.0 | 82.0 | 74.0 |
| CP-2 | 1,12-dodecanediol | 100.0 | 1,8-octanedicarboxylic acid | 100.0 | 66.0 | 90.0 | 84.0 |
| CP-3 | 1,12-dodecanediol | 100.0 | 1,10-decanedicarboxylic acid | 100.0 | 74.0 | 103.0 | 92.0 |
| CP-4 | 1,10-decanediol | 100.0 | 1,8-octanedicarboxylic acid | 100.0 | 48.8 | 66.4 | 66.0 |
| CP-5 | 1,12-dodecanediol | 100.0 | 1,12-dodecanedicarboxylic acid | 100.0 | 89.5 | 111.0 | 109.5 |

Example 1 resin 1 60 mass parts
resin 10 40 mass parts
crystalline polyester resin (CP-1) 2.5 mass parts
magnetic iron oxide 90 mass parts
(number-average particle diameter of the primary particles=0.20 μm, Hc=11.5 kA/m, σs=88 $Am^2/kg$, σr=14 $Am^2/kg$)
release agent (Fischer-Tropsch wax) 2 mass parts
(C105, melting point [mp]=105° C., Sasol)
charge control agent 2 mass parts
(T-77, Hodogaya Chemical Co., Ltd.)

These materials were premixed in a Henschel mixer followed by melt kneading in a twin-screw kneader/extruder. The obtained kneaded material was cooled, coarsely pulverized with a hammer mill, and then pulverized with a mechanical pulverizer (T-250 from Turbo Kogyo Co., Ltd.) to give a finely pulverized powder. This finely pulverized powder was classified using a Coanda effect-based multi-grade classifier to yield negative-charging magnetic toner particles having a weight-average particle diameter (D4) of 7.0 μm.

the obtained magnetic toner particles 100 mass parts
finely divided hydrophobic
silica powder 1 1.0 mass parts
(provided by carrying out a hydrophobic treatment with
30 mass parts hexamethyldisilazane (HMDS) and 10 mass parts
dimethylsilicone oil on 100 mass parts of a finely divided
silica powder having a BET specific surface area of 150 $m^2/g$)
finely divided strontium titanate
powder (median diameter: 1.0 μm) 0.6 mass parts A toner (T-1) was obtained by the external addition and mixing of these materials and screening on a mesh with an aperture of 150 μm. The formulation and properties of this toner are given in Table 5.

An evaluation of fixing with the obtained toner (T-1) was carried out as follows.

The machine used for the evaluation was a "Hewlett-Packard Laser Beam Printer (HP LaserJet Enterprise 600 M603)" that had been modified so the fixation temperature at the fixing unit was freely settable.

<The Low-Temperature Fixability>

Using this machine, an unfixed image with a toner laid-on level per unit surface area set to 0.5 $mg/cm^2$ was passed in a low temperature, low humidity environment (temperature=15° C., humidity=10% RH) through the fixing unit, which had been set at 160° C. "Plover Bond paper" (105 $g/m^2$, from the Fox River Paper Co.) was used as the recording medium. The obtained fixed image was rubbed with lens cleaning paper under a load of 4.9 kPa (50 $g/cm^2$), and the rate of decline (%) in the image density pre-versus-post-rubbing was evaluated. The results of the evaluation are given in Table 6.

(Evaluation Criteria)
A: The rate of decline in the image density is less than 5.0%.
B: The rate of decline in the image density is at least 5.0% but less than 9.0%.
C: The rate of decline in the image density is at least 9.0% but less than 15.0%.
D: The rate of decline in the image density is at least 15.0%.

<The Hot Offset Property>

For the hot offset property, a sample image having an image area percentage of about 5% was printed out on Office Planner A4 paper (basis weight=68 $g/m^2$) and was passed through the fixing unit set to 220° C. and the degree of contamination on the image was evaluated. The results of the evaluation are given in Table 6.

(Evaluation Criteria)
A: excellent
B: slight contamination
C: contamination is produced that affects the image <The Long-Term Storage Stability>

For the long-term storage stability, 10 g of toner (T-1) was measured into a 50-mL plastic cup; this was allowed to stand for 30 days in a thermostat/humidistat at 40° C. and 95%; and the blocking was thereafter visually evaluated using the following evaluation criteria. The results of the evaluation are given in Table 6.

A: Entirely absent.

B: Lumps are present, but are diminished and loosened by rotating the cup.

C: Lumps remain even though loosened up by rotating the cup.

D: Large lumps are present and are not loosened even when the cup is rotated.

<The Ejected Paper Adhesiveness>

For the evaluation of the ejected paper adhesiveness, a ten-sheet, double-sided continuous printing test was run in an environment (H/H) having a temperature of 32° C. and a humidity of 80% RH, using a test chart having a print percentage of 6% and using Office Planner A4 paper (basis weight=68 g/m$^2$). Then, with the ten sheets stacked, 7 reams (500 sheets/ream, corresponds to 3,500 sheets) of unopened Office Planner paper were stacked thereon. The load was applied for 1 hour and the status during separation was then evaluated. The results of the evaluation are given in Table 6.

(Evaluation Criteria)

A: adhesion of ejected paper is absent

B: adhesion between sheets is seen, but defects in the image are not seen when separation is effected C: defects in the image are seen when separation is effected, but not at a level that is practically problematic D: substantial defects in the image are seen when separation is effected <Fixing Member Contamination>

For the evaluation of the fixing member contamination, the extent of contamination of the fixing unit was visually evaluated as follows after 20,000 prints had been made in a high temperature, high humidity environment (temperature=32.5° C., humidity=80%). The results of the evaluation are given in Table 6.

(Evaluation Criteria)

A: Absolutely no contamination is seen.

B: Minor contamination is seen.

C Contamination that can be easily visually discriminated is seen.

D: Substantial contamination is seen.

Examples 2 to 8

Toners (T-2) to (T-8) were prepared proceeding as in Example 1, but changing to the formulations given in Table 5. The property values of the obtained toners are given in Table 5, while the results of the same testing as in Example 1 are given in Table 6.

Comparative Examples 1 to 7

Toners (T-9) to (T-15) were prepared proceeding as in Example 1, but changing to the formulations given in Table 5.

In Comparative Example 3, the "release agent (Fischer-Tropsch wax) 2 mass parts" was also changed to "release agent (paraffin wax (melting point=90° C.) 2.5 mass parts". The property values of the obtained toners are given in Table 5, while the results of the same testing as in Example 1 are given in Table 6.

TABLE 5

| | Example 1 | Example 2 | Example 3 | Example 4 | Example 5 | Example 6 | Example 7 | Example 8 |
|---|---|---|---|---|---|---|---|---|
| toner No. | T-1 | T-2 | T-3 | T-4 | T-5 | T-6 | T-7 | T-8 |
| resin component | resin 1/ resin 10 | resin 2/ resin 10 | resin 3 | resin 2/ resin 10 | resin 4/ resin 10 | resin 2/ resin 10 | resin 2/ resin 10 | resin 8/ resin 10 |
| mass ratio | 60/40 | 70/30 | 100 | 70/30 | 70/30 | 70/30 | 70/30 | 60/40 |
| resin component | CP-2 | CP-2 | CP-2 | CP-1 | CP-2 | CP-3 | — | CP-2 |
| mass ratio | 2.5 | 2.5 | 2.5 | 2.5 | 2.5 | 2.5 | — | 2.5 |
| glass transition temperature Tg (° C.) | 51.0 | 54.0 | 56.8 | 57.0 | 53.0 | 58.5 | 58.5 | 58.7 |
| peak temperature for the cold crystallization peak during cooling (° C.) | 63.0 | 63.1 | 52.0/ 61.0 | 62.8 | 46.0/ 66.0 | 63.5 | 62.7 | 44.0/ 66.0 |
| peak temperature for the endothermic peak of the resin component (° C.) | 84 | 84 | 84 | 74 | 84 | 92 | 75 | 84 |

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| toner No. | T-9 | T-10 | T-11 | T-12 | T-13 | T-14 | T-15 |
| resin component | resin 5/ resin 10 | resin 7/ resin 10 | resin 5/ resin 10 | resin 6/ resin 10 | resin 2/ resin 10 | resin 2/ resin 10 | resin 9/ resin 10 |
| mass ratio | 70/30 | 70/30 | 70/30 | 70/30 | 70/30 | 70/30 | 70/30 |
| resin component | CP-3 | CP-2 | — | CP-2 | CP-4 | CP-5 | CP-2 |

TABLE 5-continued

| | | | | | | | |
|---|---|---|---|---|---|---|---|
| mass ratio | 2.5 | 2.5 | — | 2.5 | 2.5 | 2.5 | 2.5 |
| glass transition temperature Tg (° C.) | 66.0 | 48.5 | 58.5 | 54.0 | 58.2 | 59.0 | 56.5 |
| peak temperature for the cold crystallization peak during cooling (° C.) | 62.3 | 63.2 | 83.0 | 37.0/ 66.0 | 62.5 | 85.0 | — |
| peak temperature for the endothermic peak of the resin component (° C.) | 92 | 66 | 90.5 | 84 | 66 | 109.5 | 75 |

TABLE 6

| | long-term storage stability | low-temperature fixability | fixing member contamination | ejected paper adhesiveness | hot offset property |
|---|---|---|---|---|---|
| Example 1 | A | A | A | A | A |
| Example 2 | A | A | A | A | A |
| Example 3 | A | A | A | A | B |
| Example 4 | A | A | B | B | A |
| Example 5 | A | B | B | B | A |
| Example 6 | A | A | A | A | A |
| Example 7 | A | C | B | C | A |
| Example 8 | B | A | B | C | A |
| Comparative Example 1 | A | D | A | A | A |
| Comparative Example 2 | D | A | B | C | C |
| Comparative Example 3 | C | C | D | B | A |
| Comparative Example 4 | A | B | C | D | B |
| Comparative Example 5 | D | A | C | B | C |
| Comparative Example 6 | A | D | D | A | A |
| Comparative Example 7 | D | A | B | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-160756, filed Aug. 1, 2013, which is hereby incorporated by reference herein in its entirety.

What is claimed is:

1. A toner comprising a toner particle that contains a resin component, wherein:

in a first DSC curve of the toner, measured with a differential scanning calorimeter, the first DSC curve being obtained by raising measurement temperature, the toner has a glass transition temperature of at least 50.0° C. and not more than 65.0° C., the toner has a peak temperature at a cold crystallization peak in a second DSC curve, of at least 40.0° C. and not more than 70.0° C., the second DSC curve being obtained by lowering measurement temperature, and in a third DSC curve of the resin component, measured with a differential scanning calorimeter, the third DSC curve being obtained by raising measurement temperature, the resin component has a peak temperature at an endothermic peak of at least 70.0° C. and not more than 95.0° C.

2. The toner according to claim 1, wherein the resin component contains a crystalline polyester resin and a hybrid resin in which a polyester segment and a vinylic polymer segment are chemically bonded; and wherein the polyester segment:

has a terminal of which a aliphatic compound has been condensed, the aliphatic compound being selected from the group consisting of an aliphatic monocarboxylic acid and an aliphatic monoalcohol, a peak value for the number of carbon atoms of the aliphatic monocarboxylic acid being from at least 25 to not more than 102, and a peak value for the number of carbon atoms of the aliphatic monoalcohol being from at least 25 to not more than 102.

3. The toner according to claim 2, wherein the hybrid resin has a peak temperature at a cold crystallization peak in a fourth DSC curve of at least 45.0° C. and not more than 60.0° C., the fourth DSC curve being obtained by lowering measurement temperature.

4. The toner according to claim 2, wherein the hybrid resin has a softening point, as measured using a constant-load extrusion-type capillary rheometer, of at least 120.0° C. and not more than 145.0° C.

5. The toner according to claim 2, wherein the hybrid resin has a peak temperature at a cold crystallization peak in a fifth DSC curve, and a value obtained by subtracting the peak temperature at the cold crystallization peak of the hybrid resin, from the peak temperature at the cold crystallization peak of the crystalline polyester resin, is from at least 10.0° C. to not more than 35.0° C.

6. The toner according to claim 2, wherein the crystalline polyester resin has a softening point, as measured using a constant-load extrusion-type capillary rheometer, of at least 70.0° C. and not more than 110.0° C.

* * * * *